United States Patent [19]

Egri

[11] Patent Number: 5,060,670

[45] Date of Patent: Oct. 29, 1991

[54] METHOD AND APPARATUS FOR BLOWING CUT MOISTURIZED TOBACCO MATERIAL

[75] Inventor: Laszlo Egri, Basel, Switzerland

[73] Assignee: Comas S.p.A., Treviso, Italy

[21] Appl. No.: 441,037

[22] Filed: Nov. 22, 1989

[30] Foreign Application Priority Data

Nov. 23, 1988 [DE] Fed. Rep. of Germany ..... 3839529

[51] Int. Cl.[5] ..... A24B 3/18

[52] U.S. Cl. ..... 131/304; 131/302

[58] Field of Search ..... 131/300, 301, 302, 303, 131/304, 305, 306

[56] References Cited

U.S. PATENT DOCUMENTS 3,357,436 12/1967 Wright .

FOREIGN PATENT DOCUMENTS 0285811 10/1988 European Pat. Off. .

2253882 9/1974 Fed. Rep. of Germany .

2637124 3/1977 Fed. Rep. of Germany .

2831253 3/1979 Fed. Rep. of Germany .

3147846 7/1984 Fed. Rep. of Germany .

3412797 10/1984 Fed. Rep. of Germany .

3037885 3/1988 Fed. Rep. of Germany .

2561077 9/1985 France .

*Primary Examiner*—V. Millin

*Attorney, Agent, or Firm*—Cumpston & Shaw

[57] ABSTRACT

The present invention describes a method and an apparatus for blowing cut tobacco material, wherein a stream of a carrier gas and entrained tobacco ribs is surrounded in a flow channel section at least at one point by a hot gas stream separately introduced and accelerating the afore-mentioned mixed stream. The acceleration is preferably effected at several successive points. The cover stream is introduced through annular jets, the cross-section of the flow channel remaining constant along the entire extent of the flow channel section.

12 Claims, 5 Drawing Sheets

METHOD AND APPARATUS FOR BLOWING CUT MOISTURIZED TOBACCO MATERIAL

The present invention relates to a method of blowing cut moisturized tobacco material, wherein the tobacco material is transported in a carrier gas stream of steam or steam plus hot gas, a separately introduced gas stream of steam or steam plus hot gas being admixed to said carrier gas stream at a plurality of successive mixing points, said admixed gas stream having at each mixing point a speed component in flow direction of said carrier gas stream, and to an apparatus for carrying out the method of the invention. Such method and apparatus are known from German 'Offenlegungsschrift' 26 37 124.

In order to expand cut tobacco material, in particular tobacco ribs, the tobacco material is moisturized to contain a predetermined amount of moisture and is then heated so that water diffused in the tobacco cells is converted into steam which serves as blowing agent.

U.S. Pat. No. 33 57 436 suggests a moisture content in the tobacco ribs of 16% to 35%; in German 'Offenlegungsschrift' 26 37 124, the tobacco ribs contain a moisture amount of 25% to 35%, the expansion effect only amounting to 5% to 25%. German 'Auslegeschrift' 22 53 882 and German Patent No. 30 37 885 indicate moisture contents of 40% to 55% showing increased expansion effects.

According to a series of suggestions, the restoration of the moisture content of the tobacco to the original level of freshly harvested tobacco not yet dried should be the most important factor to achieve good expansion effects. The drying of freshly harvested tobacco required by general technology causes a shrinking especially of the ribs, this shrinking causing a loss of filling capacity. The remoisturization to achieve a swelling effect is generally effected through constant addition of water, possibly steam to the tobacco; this takes frequently some time in order to make sure a uniform diffusion of moisture in the cells. The steam employed therefor is only partially absorbed by the tobacco and the non-consumed steam gets lost through evaporation.

Several suggestions are known in order to carry out the expansion in a so-called oscillation conveyor described e.g. in German 'Offenlegungsschrift' 28 31 253 wherein the cut moisturized tobacco ribs are introduced into a stream of hot moisturized air. The tobacco particles entrained by the air are moved through a plurality of vertically arranged chambers and ducts. The tobacco is advanced on an oscillating bottom, is separated from the hot air/steam mixture and dried.

German 'Offenlegungsschrift' 34 12 797 describes an oscillation conveyor wherein the moisturized cut tobacco ribs are proportionated into a perforated conveying channel; steam at a pressure of 2.5 to 25 bars and at a temperature of 126° C. to 400° C. is introduced through the perforations transverseley to the longitudinal extent of the conveying channel and to the transport movement of the tobacco, i.e. in vertical direction. An increased expansion effect is to be achieved by the condensation heat and by the mechanical vibration.

Principally, the heat transfer through condensation heat is suited for converting the water impregnated in the tobacco into steam; however, in practice it is hardly possible to equally treat the individual tobacco particles. Furthermore, an increase of the temperature of the tobacco to the indicated relatively high temperatures may cause quality losses.

Another method of expanding moisturized cut tobacco ribs is to be seen in the stream drying or pneumatic system wherein the tobacco is entrained and accelerated by a hot air and/or steam stream, as described in U.S. Pat. No. 33 57 436. However, the expansion achieved by this method with the indicated moisture content of less than 35%, the steam amount of the treatment agent and the flow rate and temperature thereof is only mediocre.

In the method of the afore-mentioned German 'Offenlegungsschrift' 26 37 124, the initial moisture of the tobacco is also relatively low. Flow rate and steam temperature in the expansion zone are not sufficient; the tobacco cannot arrive in the drying zone at an increased expansion effect. This known tobacco flow channel comprises a plurality of relatively narrowly spaced successive slots through which moisturized hot gas is directed into the flow channel such as to promote the advance movement of the tobacco. A substantial acceleration of the tobacco movement takes place in a venturi tube following the flow channel. A constriction of the flow cross-section taking place in this venturi tube may however easily cause deposits of tobacco dust within the flow channel.

German 'Auslegeschrift' 22 53 882 briefly mentioned hereinbefore discloses a pneumatic drying process wherein the tobacco is moisturized to have a moisture content of 50% and wherein the treatment medium consisting of steam and air is at a temperature of between 120° C. and approximately 400° C. and has a steam flow rate of approximately 40 m/s, the processing time being approximately 0.5 s up to less than 3 s.

It has however shown to be disadvantageous that the entire treatment, i.e. the expansion and drying steps within the same pneumatic tube causes under the very critical conditions considerable fractures, particularly if the tobacco when being in its drier state is subject to high flow rates and turbulences.

German Patent No. 30 37 885 suggests to effect the expansion and drying steps separately so that the drying step can be effected under gentler conditions, i.e. at lower temperatures and flow rates. Furthermore, the relative speed and turbulence of the tobacco are improved in the buffering phase through laterally offset steam injection inlets involving an improved heat transfer and a more uniform product. There is however involved the disadvantage that the moisturized heated tobacco is prone to form deposits in the apparatus.

German Patent No. 31 47 846 describes a method of improving the filling capacity of tobacco material wherein the moisturized tobacco material is accelerated under pressure drop to at least 50 m/s, then moved through a zone of approximately constant flow rate and then retarded in a divergent stream under pressure rise, whereby by the residence time of the tobacco material in the expansion zone is less than approximately 0.1 s. This method is carried out at hot gas temperatures of up to 1,000° C. causing the risk of permanent damages of the tobacco material.

It is the object of the present invention to avoid the afore-mentioned disadvantages and to provide a method and an apparatus eliminating the negative effects of too high tobacco temperatures, avoiding deposits or clogging, respectively, and allowing a rapid heat transfer necessary for the blowing of the tobacco through optimal utilization of the treatment agent.

The method of the present invention solves this problem by the features that the flow rate of the separately introduced gas stream is higher than the flow rate of the carrier gas stream in order to increase the relative speed between tobacco material and the gas stream carrying the tobacco material, that the separately introduced gas stream surrounds the carrier gas stream at the mixing points, and that the flow rate of the tobacco material is then retarded through an increase of the flow cross-section.

A preferred embodiment of this method is seen in the features that at the mixing points the separately introduced gas stream is introduced concentrically with respect to the carrier gas stream and that the separately introduced gas stream is at a higher inlet pressure than the carrier gas stream within the area of the mixing points, said separately introduced gas stream being preferably at a temperature between 100° C. and 200° C.

After a partial separation of the gas carrying the tobacco material from the stream, the residual stream carrying the tobacco material is preferably dried.

The method of the present invention is preferably carried out in such a manner that the tobacco material in the carrier gas stream, prior to the first admixture of the separately introduced gas stream, has a moisture content of 30% to 40% and that the separately introduced gas stream is recovered as exhaust gas stream when the tobacco material is moistured, said separately introduced gas stream suitably consisting of hot air, water vapor or a mixture of both.

The present invention further relates to an apparatus for carrying out the method described hereinbefore. This apparatus comprises a flow channel for the stream consisting of the carrier gas stream and tobacco material entrained; this flow channel has a section of uniform cross-section and is provided at at least 2 locations succeeding in downstream direction with openings for introducing the gas stream to be introduced separately. This apparatus is characterized in that the openings substantially completely surround said flow channel section; these openings being slots or being designed as a plurality of jet orifices provided along the same circumferential line, and the walls of the openings defining acute angles with the longitudinal axis of said flow channel section.

The flow channel section is preferably surrounded by an outer chamber including a gas inlet, all slots or jet orifices, respevtively, starting out from said chamber. The flow channel section consists suitably of a plurality of coaxially successive tube sections with the slots or jet orifices, respectively, being provided at the connection points thereof, the facing ends of said tube sections being preferably provided with flange rings distanced from each other by spacers and defining slots between one another.

According to the present invention, at least a portion of the treatment medium, i.e. of the carrier gas, is fed to the tobacco material under treatment at different points during the process so that also at least in a limited partial area the gas surrounds the mixture of carrier gas and entrained tobacco material as an overall cover stream in order to additionally accelerate the said mixture and preferably the gas portion thereof without having to run the risk of a constriction along the entire stream cross-section which might cause deposits which are e.g. occurring in case of acceleration by means of venturi tubes.

The introduction of a cover stream is preferably effected at several successive points in order to improve the efficiency. The separately introduced gas may be hot air, water vapor or a mixture of both and has preferably been recovered as exhaust gas from the medium by which the tobacco material was heated and moisturized before. This way, an especially economic mode of operation is achieved.

Of course, the cover streams should be introduced at increased pressure to the mixed stream of carrier gas and entrained tobacco material so that the required speed difference between the combined streams results thus causing an acceleration of the covered stream and an increase of the relative speed between tobacco material and carrier gas stream.

Upon the acceleration step, in several stages, the flow rate is reduced, e.g. through expansion of the flow channel; the tobacco is then dried. It is to be regarded as an advantage if, prior to the combination with the cover stream, the tobacco material subjected to the expansion treatment has a moisture content of 30% to 40%. Such a moisture content has shown to be sufficient so that also economic viewpoints are taken into consideration.

By the successive arrangement of several annular jets, the heat transfer to the tobacco material is considerably improved by repeatedly increasing the relative speed between tobacco material and treatment carrier gas stream, because each acceleration in the zone of the annular jet is followed by a deceleration in the subsequent intermediate zone. The process can be optimized by variation of the number of annular jets and of the length of the intermediate zones.

The concentric steam jacket furthermore safeguards a suitable tempering of the flow channel so that there cannot occur any condensation possibly rendering the tobacco material "slippery".

The present invention is explained in detail by reference to the attached drawing wherein FIG. 1 shows a complete expansion plant for carrying out the method of the invention;

Figure 1:
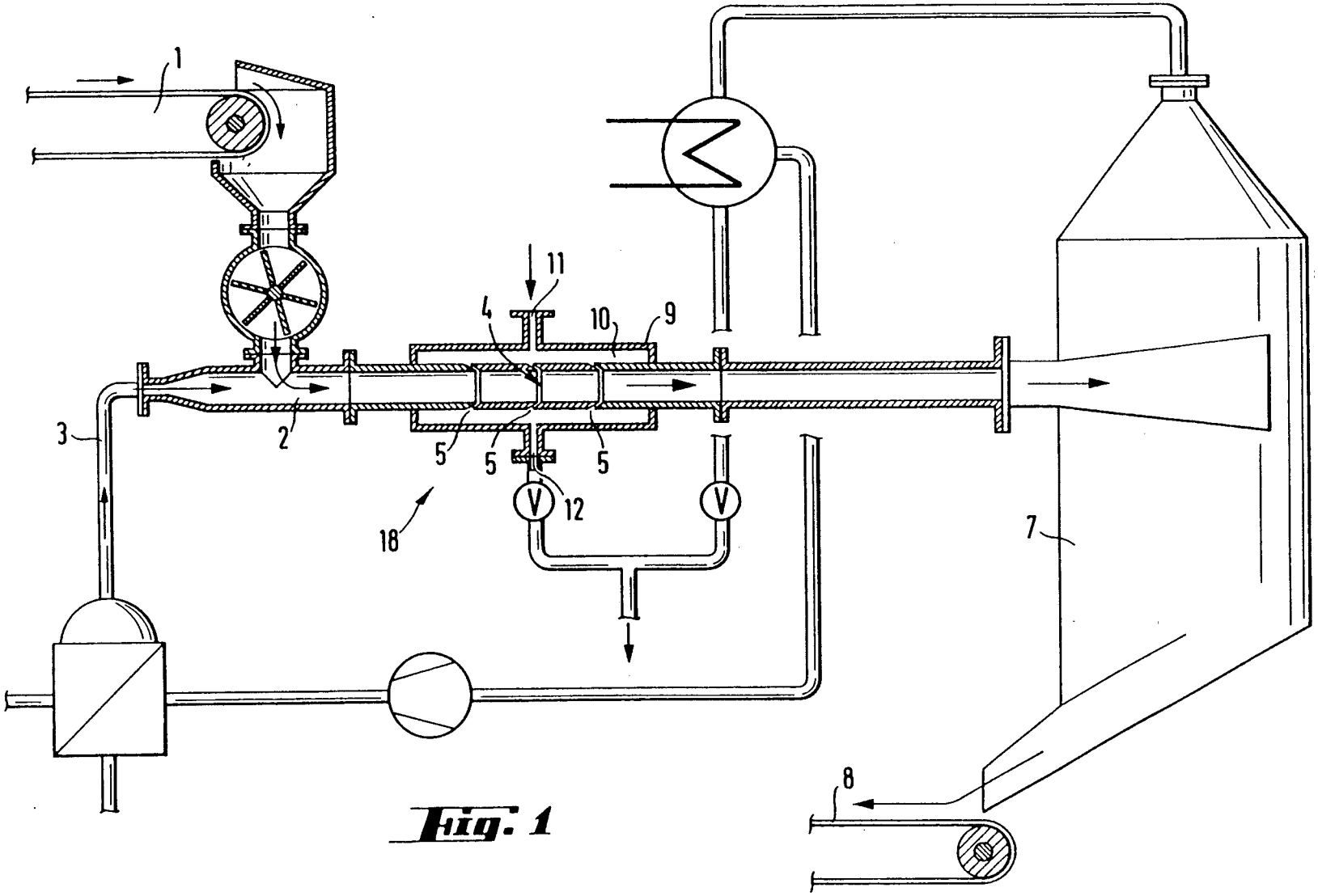

FIG. 1 shows a feeding device 1 for filling the tobacco ribs through a hopper and a proportioning means including a bucket weel into a horizontal transport channel 2, steam laterally introduced through a steam duct 3 entraining the tobacco ribs at a speed of approximately 40 m/s. The tobacco ribs are then moved to a flow channel section 4 which is provided with a plurality of successive annular jets 5. The outlet end of this flow channel section 4 is followed by a drier 7 bringing the tobacco ribs to a final moisture content of 13% and conveying the tobacco material to a transport belt 8.

The flow channel section 4 including the annular jets 5 is surrounded by a jacket 9 defining an annular chamber 10 into which a steam inlet 11 opens and from which , as shown in the example, three annular jets 5 start out. These annular jets are in communication with the interior of the flow channel section 4. The chamber 10 is further provided with a steam outlet 12 through which that portion of the steam introduced into the chamber 10 and not discharged through the jets 5 is drawn off. This steam is preferably recycled and recirculated within the plant.

The reamining elements of the plant shown in the Figures are known and need therefore not be explained in detail.

Figure 2:
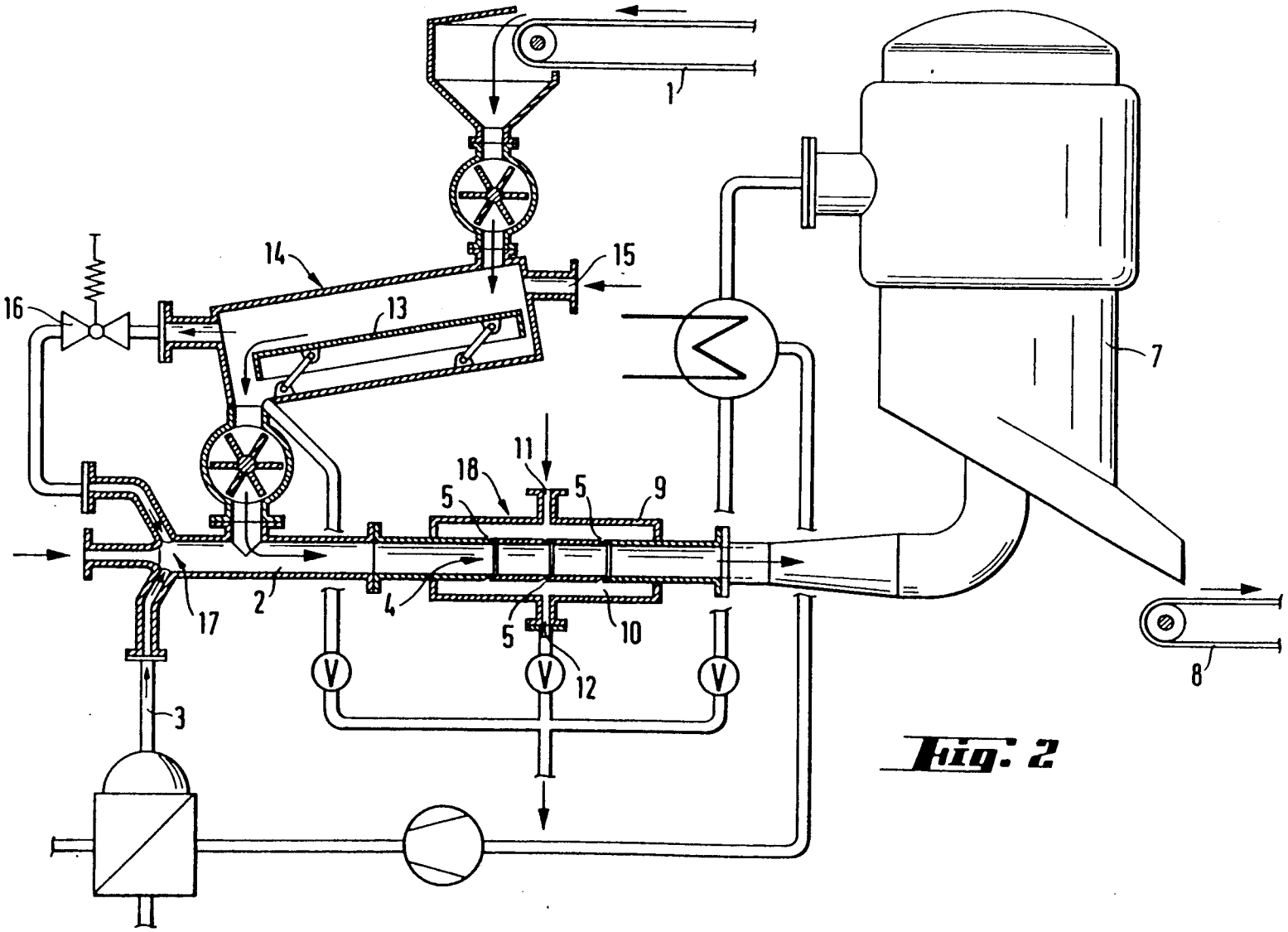
FIG. 2 shows a second embodiment of an expansion plant for carrying out the method of the invention.

A similar plant differing only with respect to the introduction of the tobacco ribs is shown in FIG. 2. The tobacco ribs are moved through a feeding means 1 and a hopper via a first bucket wheel to an inclined oscillating bottom 13 of a proportioning and moisturizing apparatus 14 into which water vapor is introduced through an inlet 15, and from there via a second bucket wheel serving as discharge gate into the horizontal transport channel 2 followed by a flow channel section 4 having annular jets 5 and by a drier 7, and from there to a transport belt 8.

In the proportioning and moisturizing apparatus 14, the tobacco ribs are treated with saturated steam, the steam coming from the proportioning and moisturizing apparatus 14 through a pressure maintaining means 16 being mixed with fresh hot steam and hot air in a mixing armature 17 opening into the horizontal transport channel 2.

Figure 3:
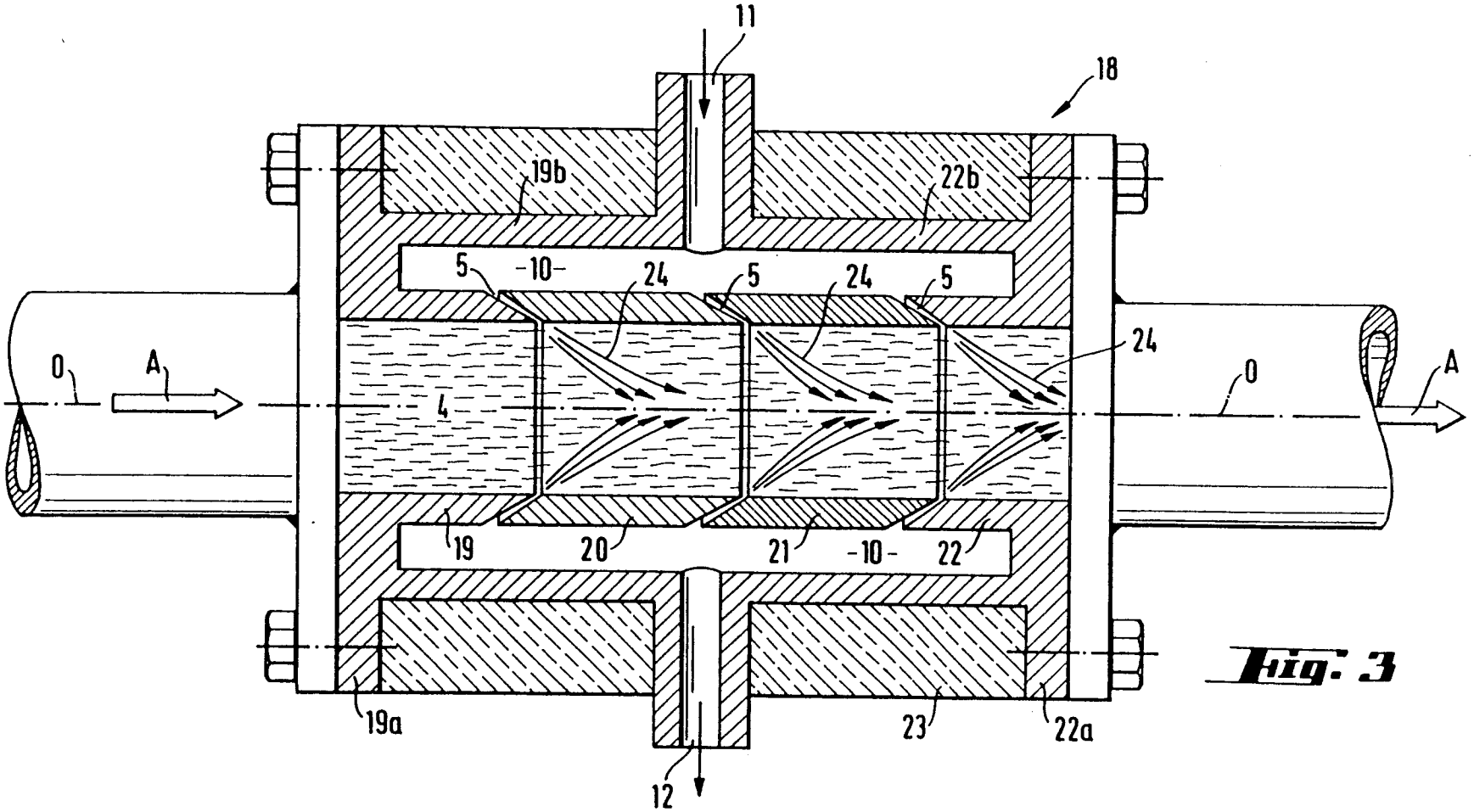
FIG. 3 shows a diagrammatic longitudinal sectional view of an essential element of the plant of FIG. 1, wherein the expansion of the tobacco ribs is carried out.

The flow channel section 4 included in the two afore-mentioned plants and comprising annular jets 5 is shown in detail in the longitudinal sectional view of FIG. 3.

FIG. 3 shows a flow channel section 4 which is defined within the expansion device entirely designated by the reference numeral 18 by a plurality of coaxially successive tube pieces 19, 20, 21 and 22. Two neighboring tube pieces each are defining an annular gap 5 which opens into the flow channel section 4. The walls of this annular gap are directed such as to define acute angles with the axis O of the flow channel section 4. The first and the last tube pieces 19 respectively 22 are provided with radially extending flanges 19*a* respectively 22*a* from which tubular sockets 19 *b* respectively 22*b* are extending towards one another to define between them and the tube pieces 19 to 22 the afore-mentioned annular chamber 10 with the annular gap 5 and the steam inlet 11 and the steam outlet 12. The tubular sockets 19*b* and 22*b* are externally surrounded by an insulating jacket 23.

When steam is introduced under pressure into the chamber 10 through the steam inlet 11, tapered steam jets are formed in the flow channel section 4, as shown by reference numeral 24 of FIG. 3. These steam jets have a speed component in the direction of the mixture of carrier gas and tobacco ribs flowing through the flow channel section 4, the flow direction being designated A. The steam jets introduced through the annular jets 5 surround the afore-mentioned mixed stream and accelerate it at several successive points.

The assembly of FIG. 3 yielded in cooperation with the plants shown in FIGS. 1 and 2 an improvement of the filling capacity of the treated tobacco ribs of 60% respectively 65% over an untreated starting material with an identical moisture content of 13% of the final product or the untreated material, respectively.

Figure 4:
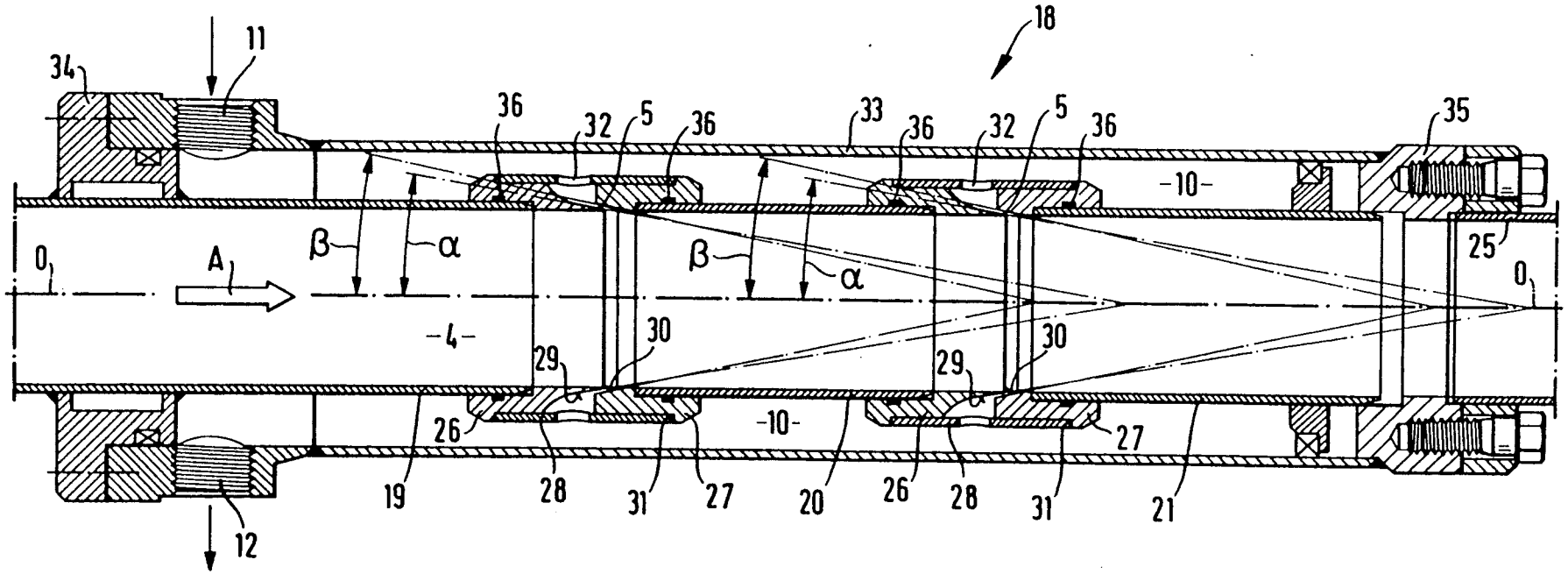
FIG. 4 is a longitudinal section through an assembly similar to that one of FIG. 3 and showing constructional details.
Figure 5:
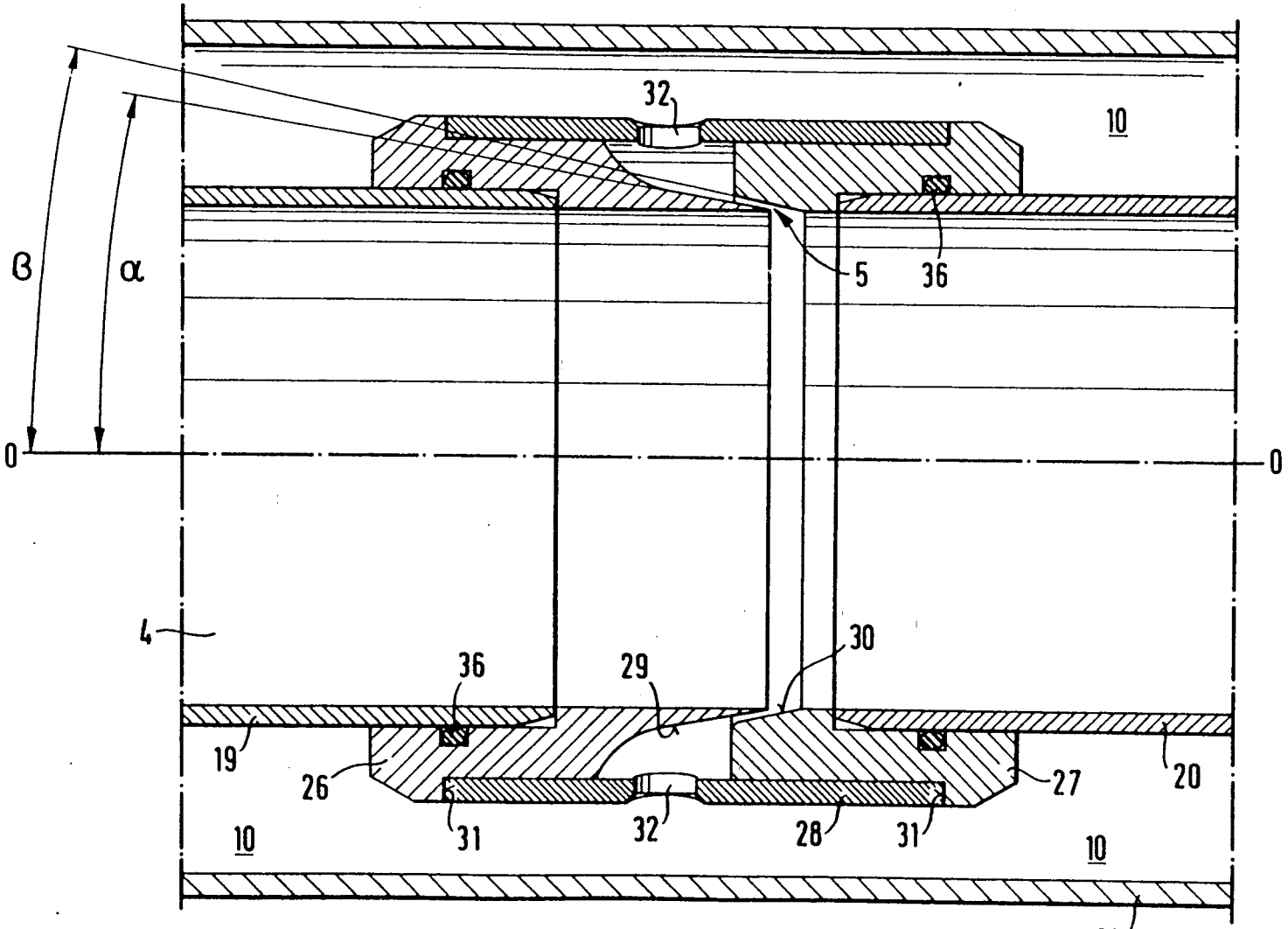
FIG. 5 shows a detail of FIG. 4 in longitudinal sectional view and on an enlarged scale.

A practical construction of an expansion device 18 having two annular jets is now being described on the basis of FIGS. 4 and 5. In the present case, the flow channel section 4 comprises three concentrically aligned tube pieces 19, 20 and 21 and a connection tube piece 25. The facing ends of the tube pieces 19, 20 and 21 are seated each in flange rings 26 and 27 and sealed therein by O-rings. Neighboring flange rings 26 and 27 are distanced each by a spacer ring 28 abutting against projections 31 of the flange rings 26 and 27. The upstream flange rings 26 and the downstram flange rings 27 have interacting ring faces 29 respectively 30 extending at acute angles $\alpha$ respectively $\beta$ with respect to the longitudinal axis O of the flow channel section 4, these ring faces extending approximately parallel to each other at a close mutual distance so that gaps being truncated annular jets 5 are defined therebetween. The spacer rings 28 have a plurality of circumferentially distributed holes 32 for access to the annular jets 5 from outside.

In the Figures, the extent of the faces 29 and 30 is shown by dashed and dash-dotted lines in order to demonstrate that these faces are defining relatively acute angles $\alpha$ and $\beta$ with the longitudinal axis O of the flow channel 4, these angles being dimensioned such that the annular gap defining the annular jet 5 is narrowed between the faces 29 and 30 from outward to inward. In the practical example, the angles $\alpha$ and $\beta$ are about 12°, and the faces 29 and 30 are spaced from each other by about 0.2 mm with an internal diameter of the flow channel section 4 having an annular cross-section of approximately 80 mm. Other gap widths are possible in response to the respective pressure of the hot gas fed to the annular jets 5 and in response to the cross-section of the flow channel section 4. They may e.g. amount up to 2 mm.

This assembly is surrounded by a tubular shell 33 defining with the tube pieces 19, 20 and 21 an annular chamber 10. The tubular shell is fixed with the one end thereof to a flange ring 34 mounted on the tube piece 19 and with the other end thereof to a flange ring 35 attached to the tube piece 21, said connection tube piece 25 already mentioned before being fixed to said flange ring 35. The afore-mentioned flange ring 34 has a stam inlet 11 and a steam outlet 12 which are opening into the chamber 10.

One can see that in case of suitable selection of the length of the jacket tube 33 possibly several tube pieces may be employed to have a greater number of annular jets.

It is to be noted that instead ofannular jets completely surrounding the flow channel section also a plurality of jets may be provided which are arranged side by side along a circumferential line. Such a ring of jets may be designed as a one-piece structural part to which the neighboring tube pieces of the flow channel section are connected, especially plugged, or they may be formed as halves each in the flange rings, as shown in FIGS. 4 and 5.

Although the apparatus has been described on the basis of the treatment of tobacco ribs, it is to be noted that it is also suited for the treatment of cut leaf material or of a mixture of cut ribs and leaf material.

A special advantage of the apparatus of the present invention is to be seen in the feature that due to the concentric cone-shaped steam injection a steam cushion is formed on the wall of the flow channel section including the annular jets so that deposits so far developed in expansion devices are avoided.

What is claimed is:

1. A method for blowing cut moisturized leaf material comprising:

transporting the leaf in a carrier gas stream of steam or steam plus hot gas;

admixing a separately introduced gas stream of steam plus hot gas to said carrier gas stream at a plurality of successive mixing points, said admixed gas stream having at each mixing point a speed component in flow direction of said carrier gas stream, in which the flow rate of the separately introduced gas stream is higher than the flow rate of the carrier gas stream in order to increase the relative speed between leaf material and the gas stream carrying the leaf material, and the separately introduced gas stream surrounds the carrier gas stream at the mixing points; and retarding the flow rate of the leaf material by increasing the flow cross-section.

2. The method of claim 1, in which the leaf material is tobacco, comprising introducing the separately introduced gas stream concentrically with respect to the carrier gas stream at the mixing points.

3. The method of claim 1, comprising introducing the separately introduced gas stream at a higher inlet pressure than the carrier gas stream within the area of the mixing points.

4. The method of claim 1, comprising introducing the separately introduced gas stream at a temperature between about 100° C. and 200° C.

5. The method of claim 1, comprising partially separating the gas carrying the leaf material from the stream; and drying the residual stream carrying the tobacco material.

6. The method claim 1, comprising moisturizing the leaf material in the carrier gas stream, prior to the first admixture of the separately introduced gas stream, at a moisture content of about 30% to 40%.

7. The method of claim 1, in which the separately introduced gas stream is recovered as an exhaust gas stream when the leaf material is moisturized.

8. The method of claim 1, in which the separately introduced gas stream comprises hot air, water vapor, or a mixture of both.

9. An apparatus for blowing cut, moisturized, leaf material, comprising:

a flow channel for a carrier stream of a carrier gas stream and leaf material entrained in the gas stream, said channel having a section of uniform cross-section; and a plurality of openings at succeeding downstream locations for introduction of a second gas stream to be separately introduced, said openings substantially completely surrounding the flow channel section, these openings comprising slots or jet orifices provided along the same circumferential line, and the walls of the openings defining acute angles with the longitudinal axis of sald flow channel section.

10. The apparatus of claim 9, comprising an external chamber surrounding said flow channel section, said chamber including a gas inlet, said openings starting out from said chamber.

11. The apparatus of claim 9, in which said flow channel comprises a plurality of coaxially successive tube pieces with the openings being provided at the connection points thereof.

12. The apparatus of claim 11, comprising:

spaced flange rings disposed at the facing ends of said tube sections; and spacers for spacing said flange rings from each other and defining slots between each other.

* * * * *